US005169184A

United States Patent [19]

Bishop

[11] Patent Number: 5,169,184

[45] Date of Patent: Dec. 8, 1992

[54] DOOR LATCH ASSEMBLY

[75] Inventor: Stephen P. Bishop, Vancouver, Canada

[73] Assignee: Masco Building Products Corp., Taylor, Mich.

[21] Appl. No.: 845,417

[22] Filed: Mar. 3, 1992

[51] Int. Cl.[5] ..... E05C 1/16

[52] U.S. Cl. ..... 292/1.5; 292/169; 292/DIG. 60

[58] Field of Search ..... 292/169, 1.5, DIG. 60, 292/337

[56] References Cited

U.S. PATENT DOCUMENTS

| | | | |
|---|---|---|---|
| 4,615,549 | 10/1986 | Couture | 292/1.5 X |
| 4,711,477 | 12/1987 | Fann et al. | 292/1.5 X |
| 4,750,766 | 6/1988 | Shen | 292/1.5 X |
| 4,921,290 | 5/1990 | Dietrich | 292/337 |
| 4,988,133 | 1/1991 | Shih | 292/191 |

*Primary Examiner*—Richard E. Moore

*Attorney, Agent, or Firm*—Myron B. Kapustij; Malcolm L. Sutherland; Edgar A. Zarins

[57] ABSTRACT

A door latch having an adjustable backset position which allows it to be used in doors having either a 2⅜" backset or a 2¾" backset. The latch includes a latch housing having a pair of aligned openings comprising two longitudinally spaced apart openings in communication with each other via a relatively narrow passageway. A cam is movable between the two openings through the passageway to adjust the backset. The cam cooperates with a retract slide which is engaged at its front end with the latch bolt to retract the latch bolt. The retract slide contains two sets of teeth at its back end, one set of teeth being engaged by the cam when it is in a first backset position and the second set of teeth being engaged by the cam when it is in a second backset position.

13 Claims, 4 Drawing Sheets

DOOR LATCH ASSEMBLY

FIELD OF THE INVENTION

This invention relates to door latches and, in particular, to a door latch having an adjustable backset to accommodate a specific door configuration.

BACKGROUND OF THE INVENTION

Typically, doors are provided with a standard backset which defines the distance between the rotational axis of the operating knob and the edge of the door from which the latch bolt extends. Most modern doors are provided with a backset of 2¾" while older doors and a minority of modern doors have a backset of 2⅜". Thus, if the door hardware needs to be replaced, the user must locate a door latch which has the identical backset. Accordingly, hardware suppliers must stock latches for both types of backsets.

Adjustable backset door latches have been developed which utilize various mechanisms to vary the distance between the door edge and the rotational axis of the latch knob. However, the available space within the door is limited and therefore the length of the latch must correspond to the door configuration. Several prior known latches with adjustable backsets employ telescopingly extendable mechanisms which require additional preparation of the door. Still other designs comprise complicated mechanisms which can not be cost-effectively manufactured or have an unacceptable failure rate.

SUMMARY OF THE INVENTION

The present invention provides a door latch which is simple in construction, readily adaptable to existing door configurations, and includes means for adjusting the backset thereof.

The adjustable backset door latch of the present invention includes an actuating cam including a pair of radially extending teeth and having a rotational axis concentrically mounted with the rotational axis of the latch handle. A retract slide is engaged at the front end thereof with the latch bolt and cooperates with the actuating cam to retract the latch bolt upon rotation of the actuating cam. The retract slide includes at its rear position two pairs of laterally extending teeth, a front pair and a rear pair, which are adapted to be engaged by the teeth of the actuating cam upon rotation of the actuating cam. Engagement of the teeth of the retract slide by the teeth of the cam forces the retract slide rearward thereby retracting the latch bolt head. The cam is rotatably mounted in case halves which enclose the operating mechanism. A latch head spring has one end thereof mounted in one case body and the other end in abutment with the latch head. Latch head spring biases the latch head to an extended position.

The case halves include a double recess opening adapted to selectively receive the rotational axis of the actuating cam. In a first or front recess, the cam pivots at a first backset position and in the second or back recess the cam pivots at the other backset position. In the first recess the teeth of the cam engage the front teeth of the retract slide while in the second recess the teeth of the cam engage the rear teeth of the slide. The actuating cam is prevented from inadvertently moving from one recess to the other by a constricted passageway between the two recesses. When it is desired to change the backset of the latch, the cam is manually forced through the constricted passageway from one recess to the other.

DETAILED DESCRIPTION OF A PREFERRED EMBODIMENT

Figure 1:
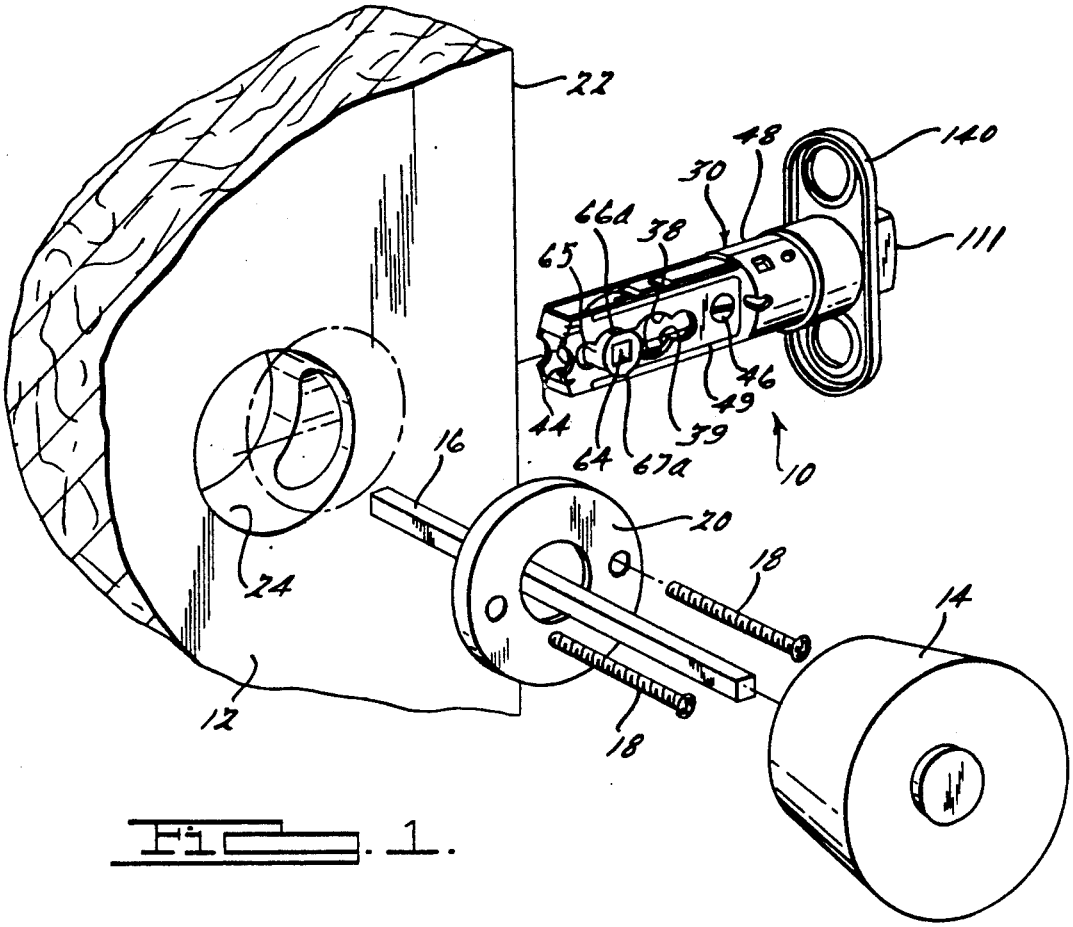
FIG. 1 is an exploded perspective view of a door latch assembly in conjunction with a door embodying the present invention.
Figure 2:
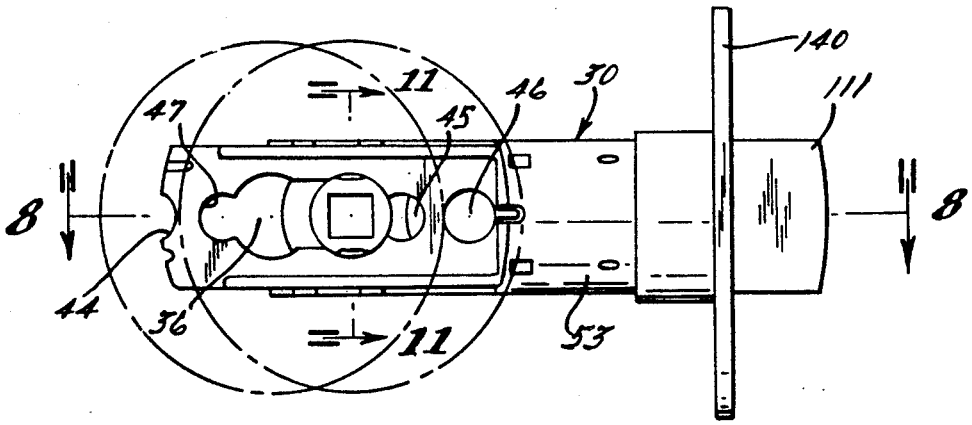
FIG. 2 is a side elevational view of the door latch assembly of the instant invention with the backset adjusted in its forward or 2⅜" position.

Referring first to FIG. 1, there is shown a latching mechanism 10 embodying the present invention mountable within a door 12. The latching mechanism 10 includes an operating handle 14 for latching and unlatching mechanism 10. The operating handle 14 may be in the form of a knob, a lever or a key lock and includes a spindle 16 which forms the rotational axis of operating handle 14. A similar operating means may be provided on the other side of the door 12. The operating handle 14 and latching mechanism 10 are retained within the door 12 by mounting bolts 18 which extend through the rose 20 and the latching mechanism 10. The present invention provides a latching mechanism 10 whereby the backset distance between the door edge 22 and the rotational axis of the operating handle 14 can be selectively adjusted between a 2⅜" backset and a 2¾" backset. Since both old and new doors 12 may be provided with a throughbore 24 it is advantageous that the latching mechanism 10 can be altered to accommodate the positioning of the bore 24 relative to the door edge 22.

Figure 3:
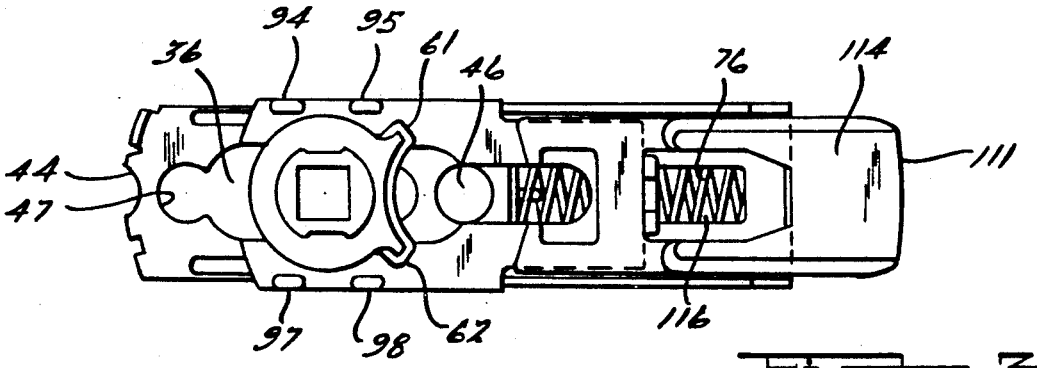
FIG. 3 is a cross sectional side view showing the latch bolt in an extended position and the actuating cam in the front backset position.
Figure 4:
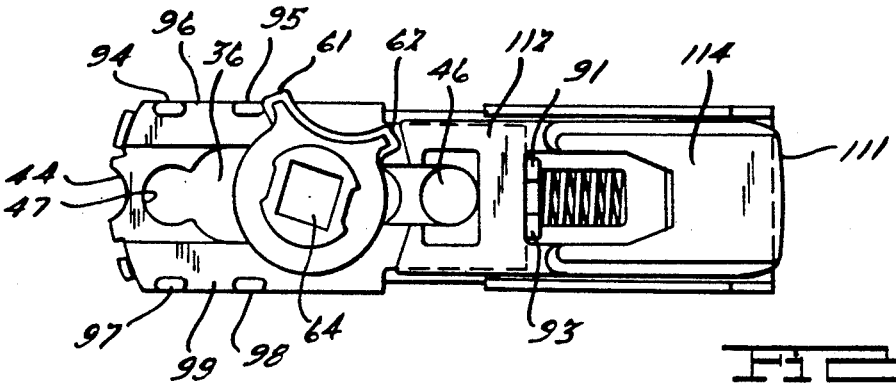
FIG. 4 is a view similar to FIG. 3 except that the latch bolt is in a retracted position.
Figure 5:
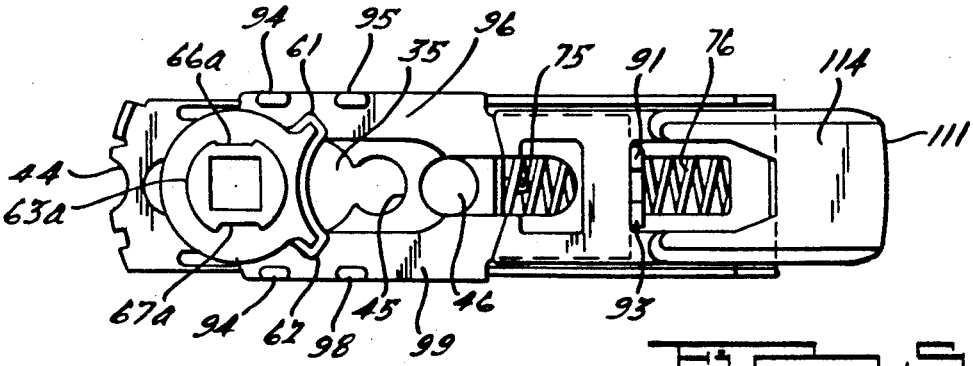
FIG. 5 is a view similar to FIG. 3 except that the actuating cam is in the rear backset position.
Figure 6:
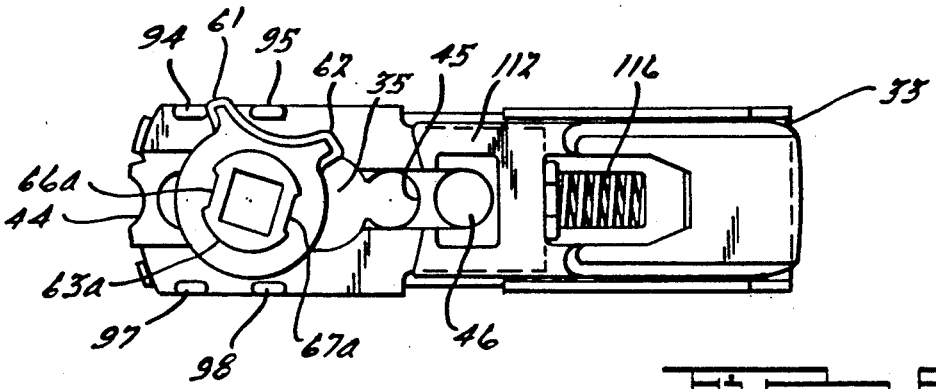
FIG. 6 is a view similar to FIG. 4 except that the actuating cam is in the rear backset position.
Figure 7:
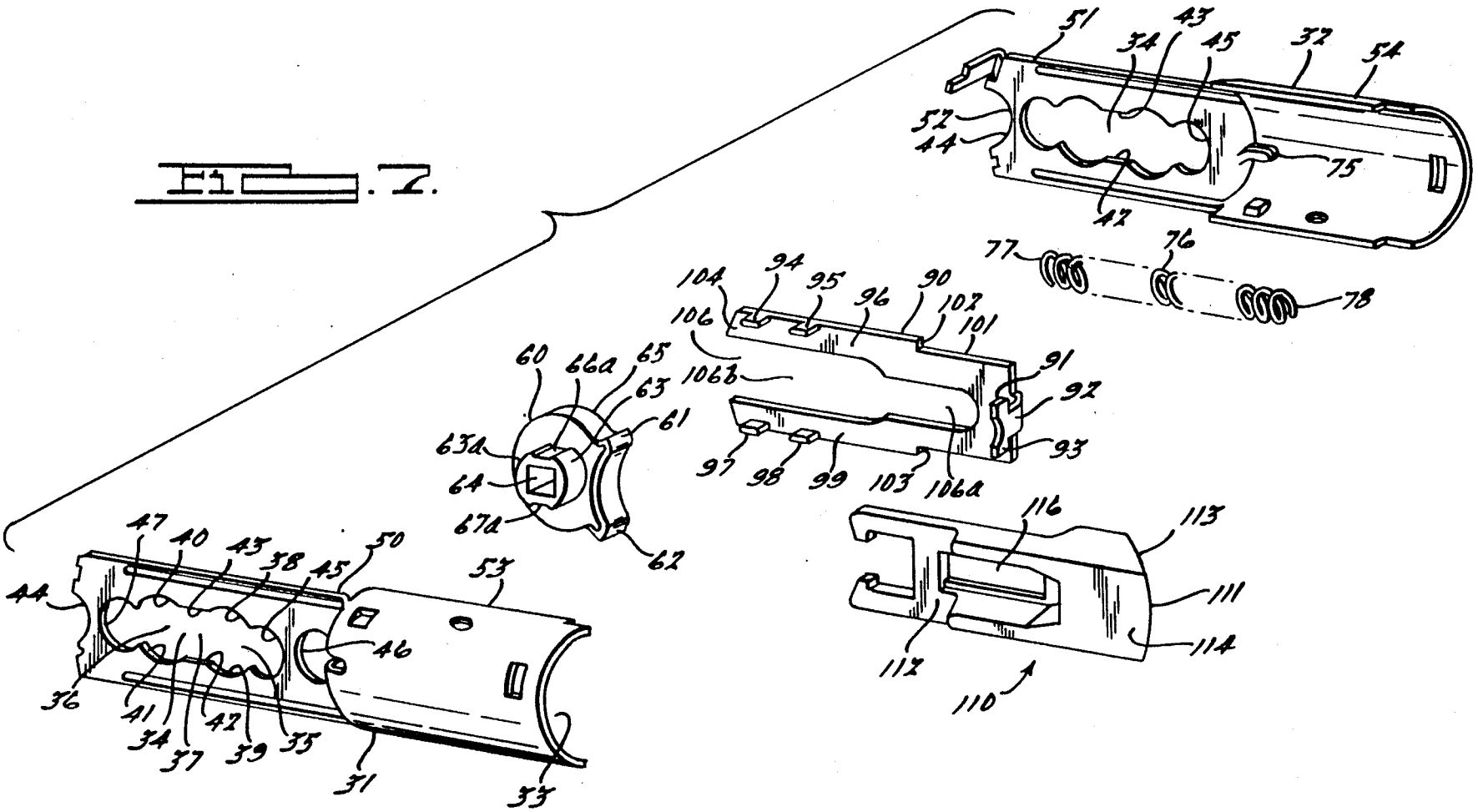
FIG. 7 is an exploded perspective view of the latch mechanism of the instant invention.
Figure 8:
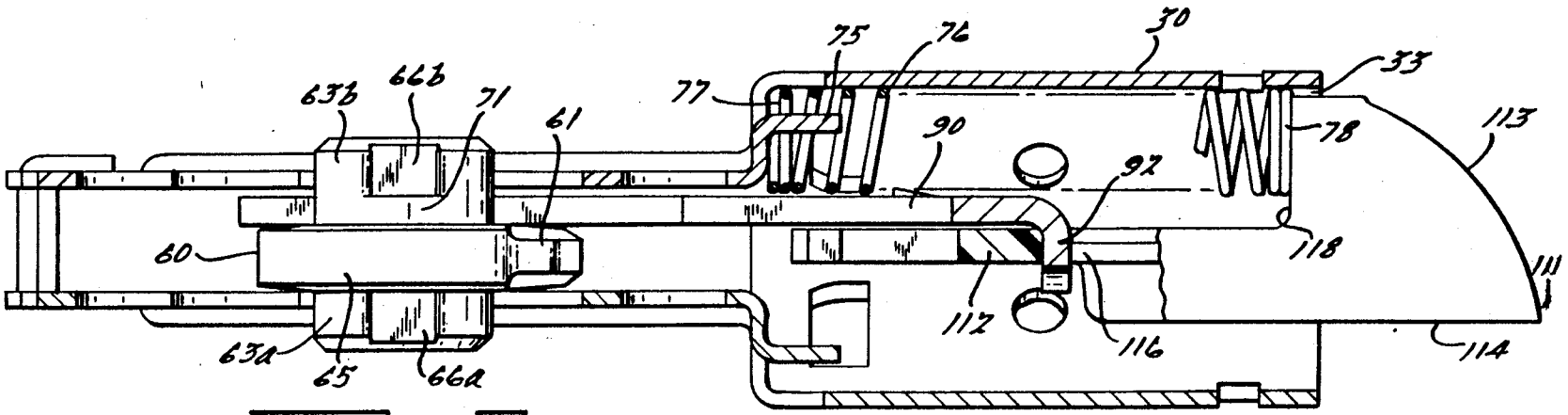
FIG. 8 is a cross sectional view taken along line 8—8 in FIG. 2.

Referring now to FIGS. 1 and 7 of the drawings, the latching mechanism 10 includes a hollow latch housing 30 adapted to retain and house the components of the mechanism 10. For ease of manufacture and assembly the latch housing 30 includes a pair of housing halves 31 and 32 adapted to be matingly assembled. The latch housing 30 includes at least one open end 33 through which latch bolt head of latch bolt element 110 is slidable longitudinally back and forth between an inwardly retracted position (FIGS. 4 and 6) and an outwardly extended position (FIGS. 3 and 5). To provide support of the assembled housing 30 and facilitate fixed mounting of the latch mechanism 10 within the outer edge 22 of the door 20, a face plate assembly 140 or a drive-in collar may be attached to the housing open end 33 and secured to the door 20 in an appropriate manner. Once secured, the latch bolt head 111 can be shifted between a retracted position (FIGS. 4 and 6) and an extended position (FIGS. 3 and 5) to unlatch and latch the door 12, respectively.

As best illustrated in FIG. 1 latch housing 30 includes a front portion 48 which is generally tubular and a rear portion 49 which is generally box shaped, said box shaped rear portion 49 generally having a rectangular cross-section and being open at the top and bottom. The front portion is comprised of two semi-cylindrical sections 53 and 54. The rear portion 49 of latch housing 30 is comprised of two flat plates 50 and 51. In the preferred embodiment as illustrated, the rear portion 49 is preferably formed integral with the front portion 48. That is to say, each latch housing half 31 and 32 is preferably a single unit which contains flat plates 50 and 51, respectively, of the rear portion 49 integrally formed with semi-cylindrical sections 53 and 54, respectively, of the front portion 48.

The latch housing halves 31 and 32 include aligned openings 34 in the flat plates 50 and 51 of the rear portion 49. The aligned openings 34 control the backset position of the operating handle 14 with respect to the latching mechanism 10. The aligned openings 34 include a first or front notch or opening 35 and a second or rear notch or opening 36 with a constricted passageway 37 defined by a dividing wall portion of the housing 30 therebetween. Top 38 and bottom 39 of opening 35 are concave and comprise arcs of a circle. Similarly, top 40 and bottom 41 of opening 36 are also concave and comprise arcs of a circle having the same radius as the circle of which top 38 and bottom 39 are arcs. Top 43 and bottom 42 sections of the dividing wall portion are linear, are parallel to each other, and are closer to each other than the top 38 of opening 35 is to bottom 39 and top 40 of opening 36 is to bottom 41, thereby defining a constricted passageway 37 between opening 35 and opening 36. In a preferred embodiment of the present invention additional openings are provided to receive mounting bolts 18 through the latch housing 30 in order to fixedly mount the latch 10 within the door 12 depending upon the backset position of the latching mechanism 10. In a preferred configuration notch 44 in the end of latch housing 30 cooperates with the end notch 45 of opening 34 to form a first set of openings to receive the mounting bolts 18 in a first or rear backset position while aperture 46 in the latch housing 30 cooperates with a second end notch 47 of opening 34 to form a second or front set of openings to receive the mounting bolts 18 in a second backset position.

Latch bolt element 110 is reciprocatably mounted within the housing 30. The latch bolt element 110 includes a latch bolt head 111 and a latch bolt body 112. The latch bolt head 111 includes a generally tapered face 113 adapted to engage a striker plate and a substantially flat abutment face 114. In the preferred embodiment illustrated the latch bolt element 110 consists of one piece, with the latch bolt body 112 formed integrally with or fixedly attached to, as for example by staking or displacing metal, the latch bolt head 111.

The latch bolt body 112 is preferably disposed intermediate the opposite faces 113 and 114 of the latch bolt head. Latch bolt body 112 consists of an H-shaped plate having a substantially rectangular opening 116 intermediate its front and rear ends cooperating with retract slide 90 as described hereinafter so that the latch bolt element 111 can be pulled rearwardly (to a retracted position) by retract slide 90.

The retract slide 90 comprises a flat plate including at its front end a hook 92 extending generally perpendicularly to said flat plate with two outwardly directed projections 91 and 93 adapted to extend through the opening 116 of the latch bolt body 112. The flat plate comprises a pair of longitudinally extending spaced apart legs 96 and 99 defining an Opening 106 therebetween. The legs 96 and 99 are narrower at their rear sections than at their front sections thereby resulting in opening 106 being narrower at its front **106*a* than at its rear 106*b*. Rear 106*b* of opening 106 is sized to receive hub section 63*b* of latch cam 60. Retract slide 90 further includes at its rear a pair of outwardly extending teeth 94 and 95 in its upper leg 96 and a pair of outwardly extending teeth 97 and 98 in its lower leg 99 against which latch cam 60 is adapted to bear when turned either clockwise or counterclockwise by rotation of spindle 16**.

Teeth 94 and 95 are engaged by tooth 61 of latch cam 60 while teeth 97 and 98 are engaged by tooth 62 of latch cam 60. More specifically, as illustrated in FIG. 4 when latch cam 60 is disposed in opening 35 clockwise rotation of latch cam 60 will cause tooth 62 to engage tooth 98 of retract slide 90 while counterclockwise rotation of latch cam 60 will cause tooth 61 to engage tooth 95, resulting in retraction or rearward movement of retract slide 90. When latch cam 60 is disposed in opening 36, as illustrated in FIG. 6, clockwise rotation of latch cam 60 will cause tooth 62 to engage tooth 97 of retract slide 90 while counterclockwise rotation of latch cam 60 will cause tooth 61 to engage tooth 94, resulting in retraction or rearward movement of retract slide 90. The engagement of tooth 61 with teeth 95 or 94, or tooth 62 with teeth 98 or 97, translates either clockwise or counterclockwise rotational movement of the operating handle 14 into a rearward or retractional longitudinal movement of the retract slide 90 and, consequently of the latch bolt element 110.

The forward or front portion 101 of the retract slide 90 is narrower than the back or rear portion 104, thereby forming two shoulders 102 and 103. The width of the front portion 101 is less than the internal diameter of the tubular front portion 48 of the latch housing 30. The front portion 101 of the retract slide 90 is thus sized to fit within the tubular front portion 48 of the housing 30. The back portion 104 of the retract slide 90 is wider than the internal diameter of the tubular front portion 48 of the latch housing and is, therefore, unable to fit within said tubular front portion. The shoulders 102 and 103 of the retract slide thus limit the longitudinal movement of retract slide 90 into the interior of the tubular front portion 48.

The latch bolt head 111 and latch bolt body 112 are adapted to move independently of the retract slide 90 so that the latch bolt head 111 can shift as it strikes the striker plate without the necessity of the latch cam 60 and operating handle 14 rotating.

Figure 9:
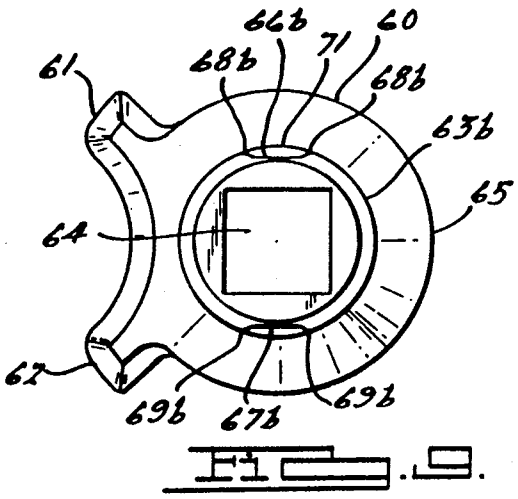
FIG. 9 is a left side elevational view of the actuating cam of the instant invention.
Figure 10:
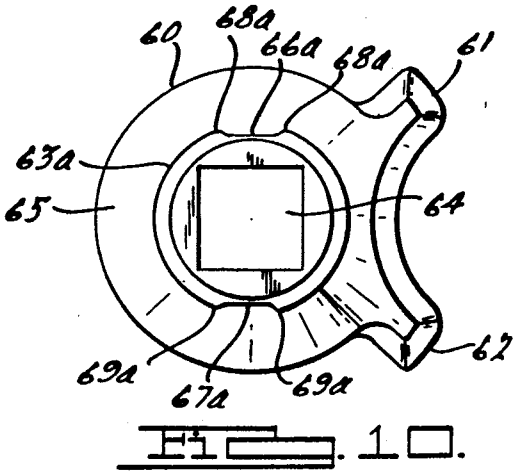
FIG. 10 is a right side elevational view of the actuating cam of the instant invention.
Figure 11:
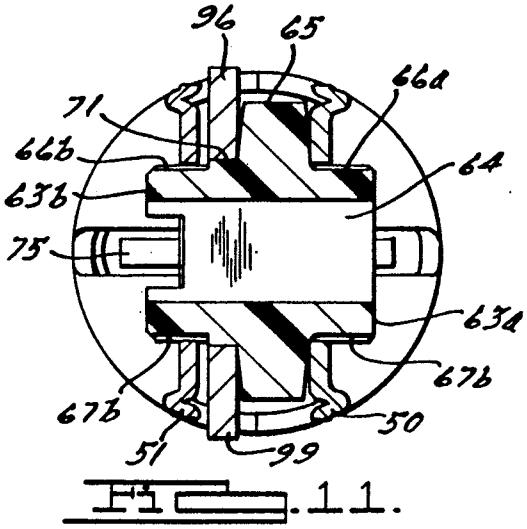
FIG. 11 is a cross sectional view taken along line 11—11 in FIG. 2.

The latch cam 60 includes a central camming section 65 having radially extending teeth 61 and 62, and a hub 63 about which latch cam rotates. The hub 63 includes a hub bore 64 configured to receive spindle 16 such that as the operating handle 14, which is attached to spindle 16, is rotated the latch cam 60 will be rotated accordingly. In a preferred embodiment the bore 64 is polygonal, preferably square or rectangular, in shape. The hub 63 extends laterally on both sides of latch cam 60 and, as best illustrated in FIGS. 9–11, comprises two hub sections 63*a* and 63*b* extending axially on either side of central camming section 65. As illustrated in FIG. 11 hub section 63*b* is longer than hub section 63*a* by an amount substantially equal to the thickness of retract slide 90. As best shown in FIGS. 9 and 10, hub sections 63*a* and 63*b* have outer surfaces which are generally circular in cross-section. The outer diameter of the circular in cross-section outer surfaces of hub sections 63*a* and 63*b* is greater than the distance between tops 43 and bottoms 42 of the constricted passageways 37 between openings 35 and 36. Two axially extending shallow grooves 66*a* and 67*a* are provided in the outer top and bottom surfaces of hub section 63*a* . The grooves 66*a* and 67*a* have flat surfaces and extend axially along the entire length of hub section 63*a* . The grooves 66*a* and 67*a* are circumferentially spaced apart from each other by about 180°. The outer diameter of hub section 63*a* is smallest at these two flat grooves 66*a* and 67*a* . This outer diameter is generally slightly less than the distance between flat tops 43 and bottoms 42 of the constricted passageways 37 between openings 35 and 36.

Two axially extending shallow grooves 66*b* and 67*b* are provided in the outer top and bottom surfaces respectively of hub section 63*b* . The grooves 66*b* and 67*b* have flat surfaces and are circumferentially spaced apart from each other by about 180°. Grooves 66*b* and 67*b* do not extend along the entire length of hub section 63*b* but, as best shown in FIG. 11, terminate short of central camming section 65 by a distance substantially equal to the thickness of the retract slide 90. The length of grooves 66*b* and 67*b* is substantially the same as the length of grooves 66*a* and 67*a*. Because grooves 66*b* and 67*b* terminate short of central camming section 65 the outer surface 71 of cam section 63*b* between the grooves 66*b* and 67*b* and central camming section 65 is circular in cross-section and functions as a bearing surface for retract slide 90. The outer diameter of hub section 63*b* is smallest at these two flat grooves 66*b* and 67*b* . This outer diameter is slightly less than the distance between the flat tops 43 and bottoms 42 of the constricted passageways 37 between openings 35 and 36.

In a backset position of $2\frac{3}{8}''$, as illustrated in FIGS. 1, 2, 3 and 4, the hub 63 is rotatably seated in front opening 35, while in a backset position of $2\frac{3}{4}''$, as illustrated in FIGS. 5 and 6, the hub 63 is rotatably seated in rear opening 36.

To accomplish backset adjustment, e.g., move latch cam 60 from opening 35 to opening 36, the hub 63 is rotated so that the flat top and bottom sections 66*a* , 67*a* , 66*b* and 67*b* are aligned with linear top and bottom sections 43 and 42 of the constricted passageways 37. The hub 63 is then urged rearwardly through the constricted passageways 37 until it clears said passageways and is seated in rear aligned openings 36. To move latch cam 60 from rear aligned openings 36 to front aligned openings 35 the aforedescribed process is carried out in reverse, i.e., the hub 63 is moved from rear aligned openings 36 through the restricted aligned passageways 37 to front aligned openings 35. While in the aligned restricted passageways 37 the hub 63 cannot be rotated.

When the hub 63, which is generally comprised of a plastic material, is urged through the constricted passageways 37 the circular in cross-section outer surfaces of hub sections 63*a* and 63*b* , being of greater diameter than the height of the restricted passageways 37, are compressed at 68*b* , 69*b* , 68*a* and 69*a* by the flat tops and bottoms 43 and 42 of the aligned constricted passageways 37 thereby allowing passage of the hub 63 through the restricted passageway. Once the hub is out of the restricted passageway and seated in openings 35 or 36 these sections 68*b* , 69*b* , 68*a* and 69*a* return or snap back to their original shape, thereby preventing the hub from inadvertently moving from one backset (opening) to another. In order to move the hub through the constricted passageways it is necessary to push the hub into the passageways with sufficient force so that the sections 68*b* , 69*b* , 68*a* and 69*a* are compressed. Thus, accidental or unwanted change of backset position is prevented.

In the assembled state of latch mechanism 10 the retract slide 90 is disposed between the latch bolt element 110 and the latch housing half 32, with the hook 92 inserted through opening 116 in body 112 of latch bolt element 110. The retract slide 90 is disposed on the side of the latch bolt element 110 opposite the substantially flat abutment surface 114 of latch bolt head 111, with the hook 92 extending through opening 116 and being disposed on the side of the latch bolt element 110 with the flat abutment surface 114.

A latch spring finger 75 projects forwardly from the interior wall of latch housing half 32 adjacent the rear end of the semi-tubular front portion 54 of latch housing half 32. One end 77 of latch compression spring 76 is mounted over latch spring finger 75. The other end 78 of latch spring 76 rests against latch spring abutment wall 118 which forms the back or rear surface of the tapered surface 113 of latch bolt head 111. Wall 118 is generally perpendicular to tapered surface 113 and forms an abutment surface for compression spring 76. The latch spring 76 is a coil spring which functions to bias the latch bolt head 111 to the extended position as shown in FIGS. 1, 2, 3 and 5.

In operation of the latch mechanism the parts in normal position when the door is opened occupy the positions and relationships illustrated in FIGS. 1, 2, 3, 5 and 8. As shown in these Figures the latch bolt head 111 is extended outwardly from the latch housing 30 through opening 33, i.e., toward the right. In this position the spring 76 urges the latch bolt head 111 outwardly. If the door is swung to a closed position the latch bolt head 111 upon striking the striker plate will move toward the left or inwardly into the housing 30 against the spring 76 until it reaches the conventional opening in the striker plate at which point it will move back to its extended position.

To open the door the handle 14 is rotated, thereby rotating spindle 16. Handle 14 can be rotated either clockwise or counterclockwise to open the door. When the spindle 16 is rotated counterclockwise cam 60 is rotated counterclockwise and tooth 61 pushes against tooth 95 or 94 (depending upon the backset) as illustrated in FIGS. 4 and 6. When the spindle 16 is rotated clockwise cam 60 is rotated clockwise and tooth 62 pushes against tooth 98 or 97 (depending upon the backset). This causes the retract slide 90 to be moved to the rear or from right to left, as viewed in FIGS. 3–7. As this movement of retract slide 90 continues hook 92 moves and pulls against the adjacent side of the rectangular opening 116 in latch bolt body 112 and draws the latch bolt head 111 from right to left until it clears the aperture in the striker plate. After the door is opened, the spring 76 returns the latch bolt head 111 to its extended position.

What is claimed:

1. A latching mechanism including a latch bolt head mountable within a door and having a rotatable operating handle, the door having an outer edge through which said latch bolt head extends, said latching mechanism having an adjustable backset distance between the door edge and the rotational axis of the operating handle, said latching mechanism comprising:

a latch bolt shiftable between extended and retracted positions;

a retract slide operably engaged with said latch bolt to shift said latch bolt to a retracted position;

biasing means operably engaged with said latch bolt for shifting said latch bolt and said retract slide to the extended position;

an actuating cam containing means for operating on corresponding first means and second means on said retract slide for shifting said retract slide to a retracted position, said cam having a first hub coaxial with the rotational axis of the operating handles;

a latch housing having an opening to rotatably receive said hub of said actuating cam, said opening containing a first portion and a second portion and dividing means between said first portion and said second portion;

said hub of said actuating cam receivable in said first portion of said opening such that the rotational axis of the operating handle is positioned in a first backset position relative to said door edge, said means on said cam operating on said first corresponding means in said retract slide to shift said retract slide and said latch bolt to a retracted position;

said hub of said actuating cam receivable in said second portion of said opening such that the rotational axis of the operating handle is positioned in a second backset position relative to said door edge, said means on said cam operating on said second corresponding means on said retract slide to shift said retract slide and latch bolt to a retracted position;

said actuating cam selectively movable through said dividing means between said first and second portions of said housing opening to adjust the backset distance of said latching mechanism.

2. The latching mechanism as defined in claim 1 wherein said latch housing comprises a pair of cooperable housing halves joined to house said actuating cam, said latch bolt, said retract slide and said biasing means, each of said housing halves having an opening with said first portion, said second portion and said dividing means to receive said hub of said actuating cam.

3. The latching mechanism as defined in claim 2 wherein said latch housing includes first and second apertures for receiving the mounting bolts of the operating handle to secure said latching mechanism within the door, the mounting bolts received in said first apertures when the operating handle is positioned in said first backset position of said latching mechanism and the mounting bolts received in said second apertures when the operating handle is in said second backset position of said latching mechanism.

4. The latching mechanism as defined in claim 2 wherein said dividing means comprises a restricted passageway formed from the wall of said housing halves between said first and second portions of said opening, said hub moving through said restricted passageway as said actuating cam is moved between said first portion and said second portion of said opening.

5. The latching mechanism of claim 4 wherein said means on said actuating cam comprise at least one radially extending tooth.

6. The latching mechanism of claim 5 wherein said means on said actuating cam comprise two radially extending circumferentially spaced apart teeth.

7. The latching mechanism of claim 5 wherein said first means on said retract slide comprise at least one laterally extending tooth engageable by said tooth on said actuating cam upon rotation of said actuating cam.

8. The latching mechanism of claim 7 wherein said second means on said retract slide comprise at least one laterally extending second tooth longitudinally spaced from said first tooth engageable by said tooth on said actuating cam upon rotation of said actuating cam.

9. The latching mechanism of claim 6 wherein said first means on said retract slide comprise two vertically spaced apart teeth, one of said vertically spaced apart teeth being engageable by one of the teeth on said actuating cam upon counterclockwise rotation of the actuating cam and the other of said vertically spaced apart teeth being engageable by the other of said teeth on said actuating cam upon clockwise rotation of said actuating cam.

10. The latching mechanism of claim 9 wherein said second means on said retract slide comprise two vertically spaced apart teeth being engageable by one of the teeth on said actuating cam upon counterclockwise rotation of the actuating cam and the other of said vertically spaced apart teeth being engageable by the other of said teeth on said actuating cam upon clockwise rotation of said actuating cam.

11. The latching mechanism of claim 10 wherein said retract slide comprises a flat plate being bifurcated into two longitudinally extending legs at one end thereof.

12. The latching mechanism of claim 11 wherein said hub of said actuating cam is receivable in an opening defined by said two longitudinally extending legs of said retract slide.

13. The latching mechanism of claim 12 wherein said hub is a bearing surface for said retract slide.

* * * * *